US006300026B1

(12) United States Patent
Yamazaki et al.

(10) Patent No.: US 6,300,026 B1
(45) Date of Patent: Oct. 9, 2001

(54) ELECTROPHOTOGRAPHIC PHOTOCONDUCTOR

(75) Inventors: Mikio Yamazaki; Osamu Nabeta, both of Nagano (JP)

(73) Assignee: Fuji Electric Imaging Device Co., Ltd. (JP)

( * ) Notice: Subject to any disclaimer, the term of this patent is extended or adjusted under 35 U.S.C. 154(b) by 0 days.

(21) Appl. No.: 09/711,044

(22) Filed: Nov. 13, 2000

(30) Foreign Application Priority Data

Nov. 16, 1999 (JP) ..... 11-325249

(51) Int. Cl.[7] ..... G03G 5/04
(52) U.S. Cl. ..... 430/56; 430/59.4
(58) Field of Search ..... 430/56, 59.4

(56) References Cited

U.S. PATENT DOCUMENTS 4,587,191 * 5/1986 Clark ..... 430/56
4,615,963 * 10/1986 Matsumoto et al. ..... 430/56

* cited by examiner

*Primary Examiner*—John Goodrow
(74) *Attorney, Agent, or Firm*—Morrison Law Firm

(57) ABSTRACT

A photoconductor includes a conductive substrate, an undercoat layer on the substrate, and at least one photosensitive layer on the undercoat layer. The radius of vacancy type defects in each of the photosensitive layer and in the undercoat layer is o.4 nm or less. In one embodiment, the radius of vacancy type defects is measured by a positron annihilation method.

10 Claims, 3 Drawing Sheets

ELECTROPHOTOGRAPHIC PHOTOCONDUCTOR

BACKGROUND

The present invention relates to an electrophotographic photoconductor (also called "a photoconductor") and, more specifically, to a relationship between an electrophotographic characteristic and the radius of the, vacancy type defects which are present in the functional layer of a photoconductor, in which the radius is a value measured by a positron annihilation method.

Since the invention by Carlson disclosed in U.S. Pat. No. 2,297,691, numerous photoconductors have been developed including photoconductors using organic materials, such as phthalocyanines or azo compounds, as a charge generating material, as well as photoconductors using inorganic materials, such as amorphous silicon, a selenium-tellurium compound, or a selenium-arsenic compound.

In particular, a printer, a digital copier, a facsimile machine, or a digital image-processing complex machine capable of combined functions of these machines, occasionally uses a semiconductor laser emitting at a wavelength of 635 nm to 780 nm as an exposure light source for the photoconductor. For those apparatuses, photoconductors having sensitivity in that wavelength range have been developed. Phthalocyanines have been extensively studied as photoconductors for such a long wavelength light source because the phthalocyanines exhibit a large absorptivity in the wavelength range of a semiconductor laser as compared to other charge generating materials, and has excellent charge generating capability in that wavelength range. Photoconductors are known at present using phthalocyanines having a core metal of copper, aluminum, indium, vanadium or titanium, for example, as disclosed in Japanese Unexamined Patent Application Publication (KOKAI) Nos. S53-89433 and S57-148745, and U.S. Pat. Nos. 3,816,118 and 3,825,422.

Further, phthalocyanine oligomers are known, which show an excellent photoconductive characteristic in that wavelength range, such as $\mu$-oxo-Ga(III) phthalocyanine dimer and $\mu$-oxo-Al(III) phthalocyanine dimer. These have been studied for photoconductor application as disclosed by Yamazaki et al. in Nihon-Kagakukai-shi (Journal of The Japanese Chemical Society) 1997, No. 12, p. 887.

In the apparatuses equipped with a white light source such as an analogue copier, a photoconductor in the mainstream uses the charge generating material of a bisazo compound, which has sensitivity in the light wavelength range between 400 nm and 650 nm.

A photoconductor of a so-called function-separated type comprises a charge generation layer and a charge transport layer formed on an electrically conductive substrate optionally through an undercoat layer that is formed if required. The charge generation layer comprises a resin binder and particles of above-described pigments dispersed in the resin binder. The charge generation layer has a thickness of about 1 $\mu$m or less. The charge transport layer is formed by dissolving a charge transport material of relatively low molecular weight in a resin binder including polycarbonate resin for example, to become a so-called molecular dispersion state. The film thickness of the charge transport layer is generally in the range between 10 $\mu$m and 30 $\mu$m. The charge transport material has a partial structure for serving charge transport function, such as butadiene-, triphenylamine- or hydrazone-structure. In addition, an alkyl group or a polar group like a halogen atom is often introduced into the charge transport material. The alkyl group provides compatibility with the resin binder and a solvent. The polar group serves to adjust electronic properties, such as ionization potential, that relate to charge transport ability of the material. In recent years, a resin binder has been proposed, in which a molecular structure having charge transport function is introduced into a side chain or a portion of a principal chain of the resin binder so that the binder itself serves a charge transport function while maintaining its mechanical characteristic of a binder.

The charge transport layer of conventional photoconductors suffers from deterioration of electrical characteristics, for example increase of residual potential, due to charge trapping at the trapping sites existing in, for example, the intermediate product included as impurities of synthesis process of the charge transport material, the residue of the catalyst used in synthesis process of the charge transport material or the binder resin, or the photocomposition product produced by light exposure of the photoconductor in use or of the coating-liquid in the manufacturing process. The charge trapping could also be caused by inhomogenuity in the molecular structure of the binder resin, namely, inhomogenuity of the folding structure of the principal chain, or variation of the end groups of the resin. Minute voids in the resin could also be sites of electrical trapping.

A photoconductor commonly requires good charging capability, small attenuation in the dark, and a small residual potential. Further, these properties should not change in repeated use. However, when the combination of the resin and the charge transport material is so improper that a large number of above-described defects are generated, such electrical characteristics cannot reach the required level. While a photoconductor using a phthalocyanine compound as a charge generating material, in particular, exhibits high sensitivity in the high wavelength range as described earlier, such a photoconductor has a disadvantage in that the charged voltage is low in the first turn and stabilizes on the second and later turns. When such a photoconductor is used in a process that utilizes the first turn for image formation, non-uniformity in the printed image occurs due to low charged potential in the first turn.

With the increase in processing speed of CPU and data transfer rates in recent years, higher printing speed is needed. Therefore, utilization of the first turn of the photoconductor for image formation has become an important subject for high-speed start-up of a printer and a digital copier. The above-described instability of charged potential may be attributed to the following mechanism. The charges generated in the dark in the charge generation layer are trapped at the trapping sites as mentioned earlier in the interface between the charge generation layer and the charge transport layer, and in each of the layers in the photoconductor. The trapped charges are released in the first turn of the charging period, resulting in excessive cancellation of the surface charges, which leads to a lower charged potential. Therefore, reducing the density of the trapping sites is an important technical target for preventing the unsteady charging characteristic.

OBJECTS AND SUMMARY OF THE INVENTION

In view of the foregoing, it is an object of the present invention to provide an electrophotographic photoconductor that exhibits a stable and excellent charging characteristic and allows utilization of the first turn of the photoconductor for image formation.

The inventors have made extensive studies of organic photoconductors with numerous combinations of materials in the charge generation layer and the charge transport layer for reducing the density of the above kind of trapping sites. They have found that photoconductors having a radius of vacancy-type defects in the photosensitive layer or in the undercoat layer of 0.4 nm or less do not suffer from the unsteady charging characteristic and exhibit excellent photoconductor characteristic. The radius of vacancy-type defects is a value measured by a positron annihilation method. This finding led to the accomplishment of the present invention.

To solve the above problem, there is provided according to the present invention an electrophotographic photoconductor comprising a conductive substrate and at least one photosensitive layer on the substrate, wherein a radius of vacancy-type defects in the photosensitive layer measured by a positron annihilation method is 0.4 nm or less.

Another photoconductor of the invention comprises a conductive substrate, an undercoat layer on the substrate, and at least a photosensitive layer on the undercoat layer, wherein a radius of vacancy-type defects existing in each of the photosensitive layer and the undercoat layer is 0.4 nm or less, the radius being a value measured by a positron annihilation method.

Advantageously, the photoconductor of the invention is a laminated-layer type in which the photosensitive layer comprises a charge generation layer and a charge transport layer. However, the photoconductor of the invention may be of a single-layer type.

In the photoconductor of the invention, the lifetime in the conductive substrate of a positron which is injected from an external radiation source is advantageously 0.3 ns or shorter.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

First, a positron annihilation method in the present invention is described.

A positron annihilation method is a method in which a positron is injected into physical matter from a positron source and the lifetime of the positron is measured to estimate the size and density of defects in the matter. A positron is an anti-particle of an electron, and is an elementary particle having the same mass and the opposite charge as an electron. It is known that a positron and an electron form an electron-positron pair by Coulomb force when the two particles meet in a molecular crystal or in an amorphous solid material, and then the pair annihilates, as described by Doyama et al. in Materia, vol. 35, No. 2, pp. 91–173 (1996).

The positron-electron pair behaves as a particle in this bound state. The pair is called a positronium. When a positronium annihilates, an annihilation γ-ray with the energy of 511 keV is emitted in two directions with an angle of 180° between them. In the positron annihilation method, a positron lifetime is determined by measuring the time variation of intensity of the annihilation γ-ray. There are two types of positronium: a para-positronium and an ortho-positronium. The spins of the electron and the positron are anti-parallel in the para-positronium and parallel in the ortho-positronium.

While a lifetime of a para-positronium is 0.13 ns, a lifetime of an ortho-positronium depends on electron density in the surroundings of the positronium. The mean lifetime of an ortho-positronium is about 140 ns when it is annihilated in a self-annihilation process. However, the lifetime decreases down to the range from 1 to 5 ns when it annihilates through a "pick-off" process in which the positronium takes electrons from the surrounding matter. When an ortho-positronium exists in a vacancy-type defect, a lifetime of the positronium positively correlates with the size of the defect. With increase in the size of the vacancy-type defect, the probability with which the ortho-positronium takes pick-off annihilation with an electron oozed out from the inner wall of the defect decreases, resulting in longer lifetime of the ortho-positronium. Thus, the size of the defect can be determined by measuring the lifetime of the ortho-positi-onium on the pick-off annihilation. It is known, however, that the lifetime of a positronium tends to saturate when the radius of the defect increases beyond a. certain value, namely, about 0.5 nm, as described in the above-cited reference by Doyama. That means that the maximum value of the radius of a defect measurable by this method is 0.5 nm.

An outline of a principle of measuring a positron lifetime in the invention is as follows.

Figure 4:
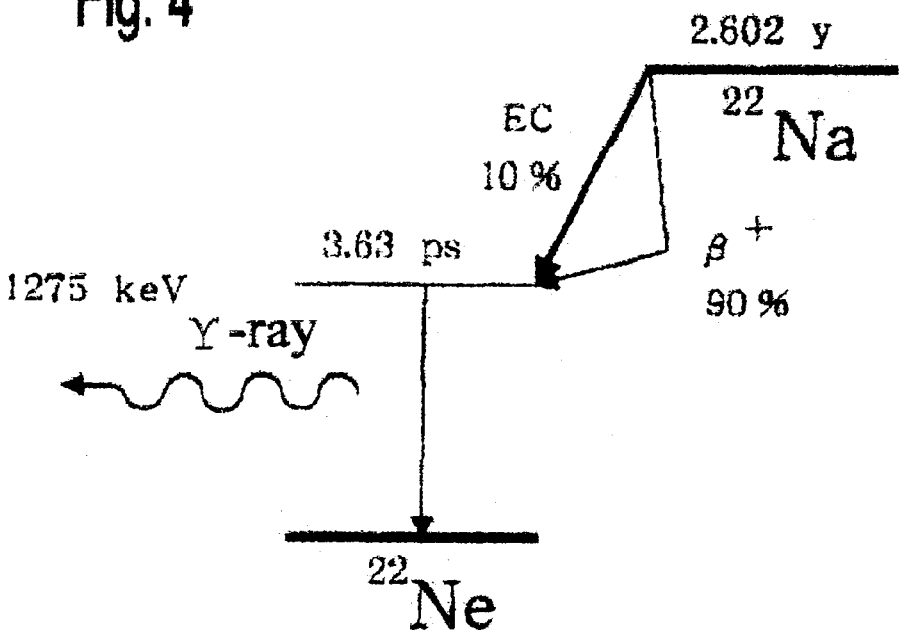
FIG. 4 is a drawing showing the decay scheme of $^{22}$Na.

A positron source generally used in laboratory system is a radioactive isotope which has a relatively long lifetime. The source emits a positron and a τ-ray almost simultaneously with a $\beta^+$ decay. $^{22}$Na with a γ-ray intensity of 250 kBq to 630 kBq was used in an embodiment of the invention. The energy distribution of the positron from this source is continuous with a maximum of 540 keV and an average of 220 keV. FIG. 4 shows the decay scheme of $^{22}$Na.

A positron injected into solid matter penetrates to a depth of about 0.1 mm where it generates a damaged region called a spur along the track of the positron. The positron loses its energy in about 1 ps, and thermalizes slowing down to an energy of 200 eV. Such a positron is called a thermal positron. Some of the thermal positrons diffusing in the spur, meet an electron and disappear (or annihilate) in a lifetime of 0.4 ns. Upon annihilation, an annihilation γ-ray is emitted. This process is called free annihilation and is a dominant disappearing process in metal. On the other hand, in a molecular crystal, a positron and an electron tends to form a positronium.

Figure 2:
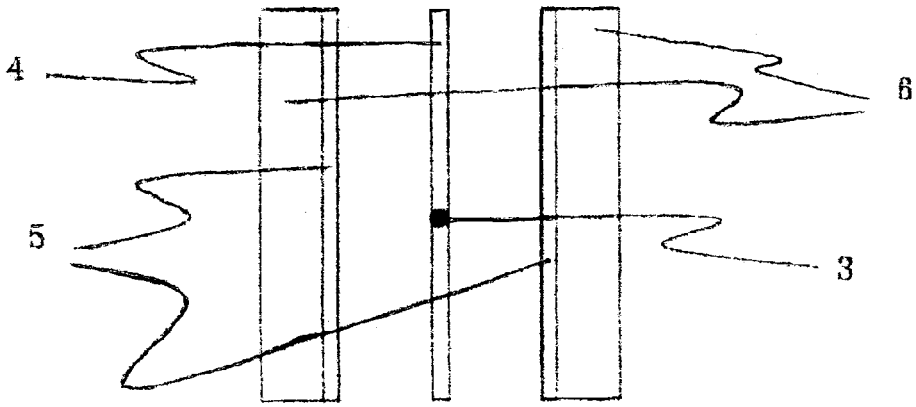
FIG. 2 is an enlarged view showing a photoconductor specimen in the invention.

A photoconductor specimen for this measuring method can be prepared without any treatment except for cutting the practical photoconductor into a suitable size. As shown in FIG. 2, a radiation source 3 is sandwiched between two pieces of photoconductor specimens 5. A Kapton film 4 is disposed between the charge generation layers of the photoconductor specimen beyond the radiation source. An aluminum substrate 6 serves as the substrate for each of the two photoconductor specimens.

Figure 1:
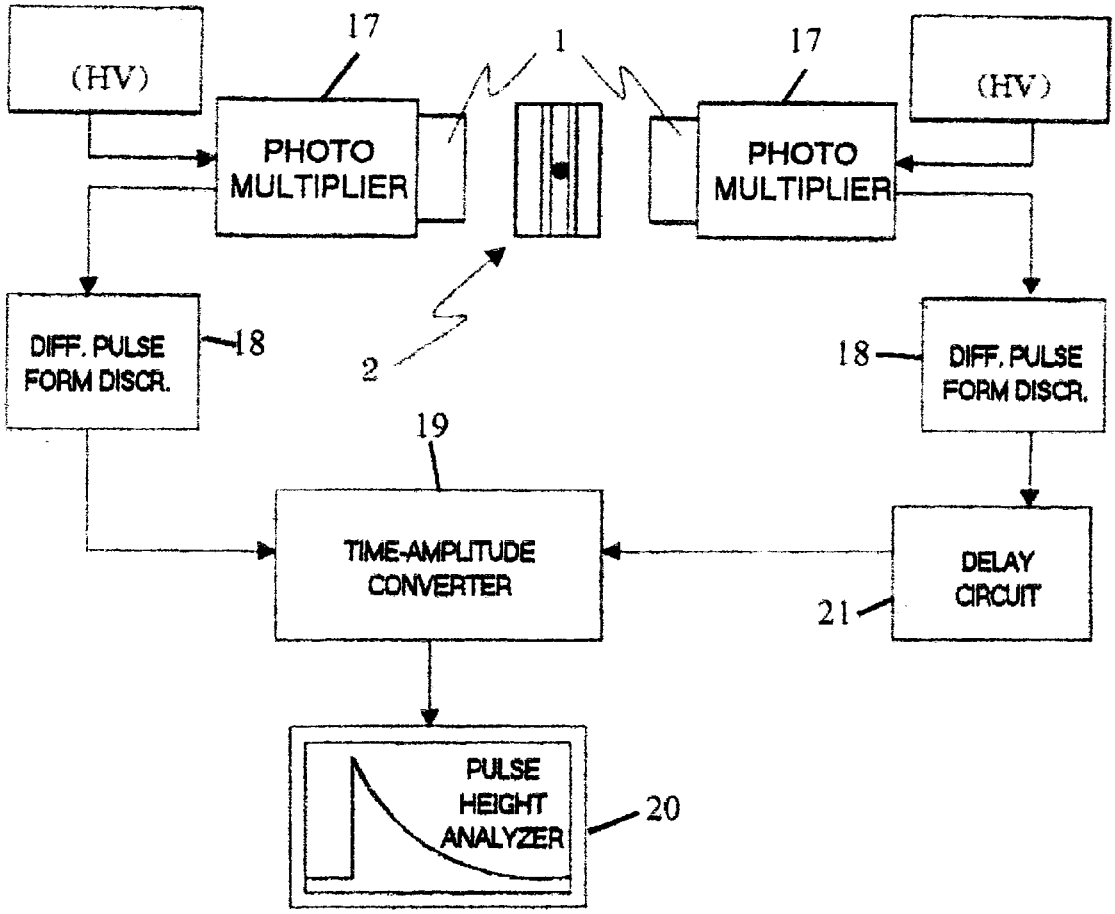
FIG. 1 is a flow chart showing an apparatus for measuring the positron lifetime in the invention.

Referring to FIG. 1, the specimen with the radiation source 2 is installed in a positron lifetime measurement system shown in FIG. 1 with the specimen sandwiched between two plastic scintillators 1 mounted on photomultiplier tubes 17 (PMT). The γ-ray of 1275 keV emitted upon the event of the decay of $^{22}Na$ to $^{22}Ne$ enters the first of the scintillators 1. The signal accompanied by the γ-ray incident on the first scintillator is discriminated by a differential pulse form discriminator 18. This signal is designated as a start signal for the measurement. The second scintillators 1 opposite to the first scintillators 1 detects the γ-ray of 511 keV which is emitted at annihilation of the positron that is generated at about the same time as the decay, that entered into the specimen, and disappeared there. The signal from the second scintillator 1 is then discriminated and designated as an end signal.

The start signal and the end signal enter a time-amplitude converter (TAC) 19. The time difference between the two signals is measured, and analyzed by a pulse height analyzer (PHA) 20. The analyzed result is stored to obtain a time spectrum of the positron annihilation. The ordinate of the time spectrum represents the count number of the scintillators 1. The count number is proportional to the positron number. The abscissa represents the channel number of the pulse height analyzer that is proportional to time. The positron annihilation spectrum L(t) can be represented by a superposition of exponential functions as shown by the formula (1) below:

$$L(t) = \sum_n \frac{I_n}{\tau_n} \exp\left(-\frac{t}{\tau_n}\right) \tag{1}$$

Where, $\tau_n$ ($n \geqq 1$) is a time constant of n-th component of the spectrum, and $I_n$ is an intensity of the n-th component. Each component of the spectrum corresponds to a different annihilation mechanism.

The lifetime of the positronium generally corresponds to a time constant $\tau_n$ corresponding to each of the annihilation mechanisms. The time constant of the annihilation of an ortho-positronium through the pick-off mechanism, in particular, can be correlated to a radius R of a vacancy by the following formula (2) as disclosed by H. Nakanishi et al. in "Positron Annihilation Studies in Fluids" in S.C. Sharma, ed.; World Science: Singapore, 1988, p. 292.

$$\tau_n = \frac{c}{2}\left\{1 - \frac{R}{R+\Delta R} + \frac{1}{2\pi}\sin\left(\frac{2\pi R}{R+\Delta R}\right)\right\}^{-1} \tag{2}$$

Here, $c=1\times10^{-9}$[s]

The formula (2) gives the relationship between a lifetime $\tau_n$ of an ortho-positronium and a radius R of a vacancy when the ortho-positronium is assumed to exist in a spherical potential with a radius R accompanied by an electron layer of thickness ΔR, that is a model of the vacancy. The numerical value of ΔR is determined to be 0.166 nm by the experiments on some organic crystals and zeolites having known vacancy radius, through curve-fitting of the pairs of the obtained lifetime and the known vacancy radius, based on the formula (2). This value was employed in the invention. The measured spectrum of positron annihilation is analyzed by the formula (1) and the obtained value of the time constant τ is used to find R by numerically solving the formula (2), to determine the radius of the vacancies in the photoconductor specimen.

Figure 3:
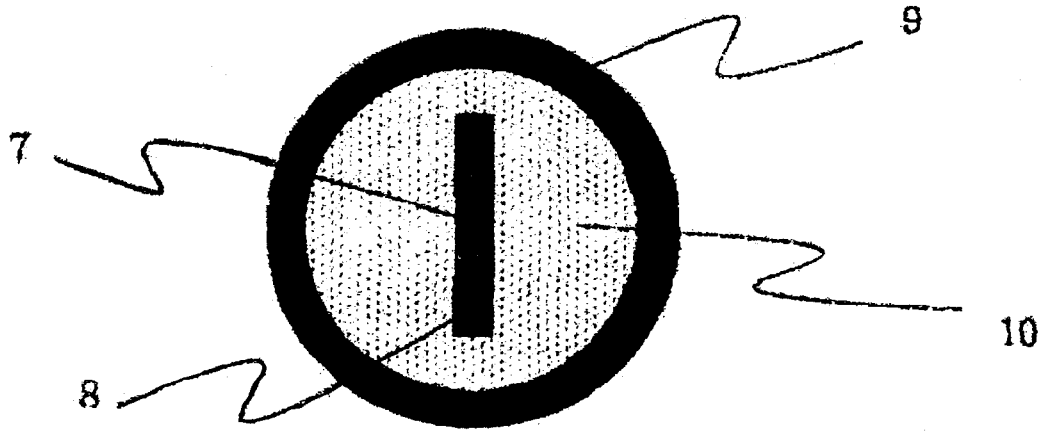
FIG. 3 is an enlarged view showing a powder specimen in the invention.

The above-described measurement may be performed on a powder specimen as shown in FIG. 3. A point radiation source 7 is centered in a Kapton foil 8. The Kapton foil 8 has a thickness of, for example, 7.5 μm. A glass bottle 9, with diameter of 21 mm, for example, contains the point radiation source 7, the Kapton foil 8, and a powder specimen 10. The glass bottle 9 is preferably sealed with epoxy adhesive, for example.

Now, a photoconductor of the invention will be described in detail.

The positron annihilation method in the invention does not require any special processing and allows a practical product of a photoconductor to be made to measurement. Therefore, the photoconductor of the invention may be produced by the same manufacturing method and in the same structure as a conventional photoconductor. Other techniques for measuring may be substituted for the positron annihilation method without departing from the spirit and scope of the invention.

Figure 5:
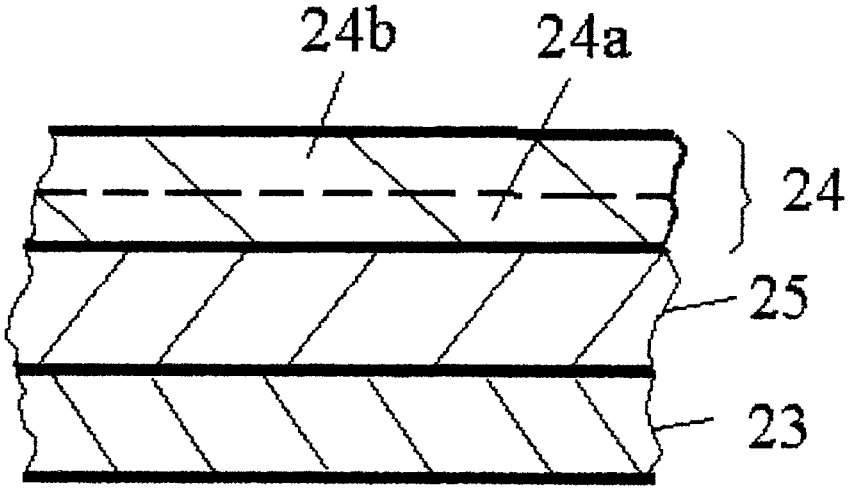
FIG. 5 is a cross section of an electroconductive photoconductor according to an embodiment of the invention.

Referring now to FIG. 5, a photoconductor of the invention comprises a conductive substrate 23 and at least one photosensitive layer 24 on the substrate. The photosensitive layer 24 may be formed as a laminated-layer structure consisting of a charge generation layer 24*a* and a charge transport layer 24*b* separately, or as a single-layer structure 24. An undercoat layer 25 may be provided if necessary.

While some embodiments of the photoconductor of the invention will be described with respect to the laminated-layer type, the invention is not limited to this type of a photoconductor.

The conductive substrate may be formed as a cylinder of metal such as aluminum, or a film of conductive plastics. Alternatively, a molded body or a sheet made of glass, acrylic resin, polyamide, or poly(ethylene terephthalate) may be used with an electrode attached thereto.

The undercoat layer may be formed using a material selected from an insulative polymer, such as casein, poly (vinyl alcohol), poly(vinyl acetal), nylon, melamine or cellulose; a conductive polymer, such as polythiophene, polypyrrole, poly(phenylene vinylene) or polyaniline; and one of these polymers containing a metal oxide such as titanium dioxide or zinc oxide. The conductive substrate may also be used by coating the surface thereof with oxidized aluminum film instead of forming the above-described undercoat layer.

The charge generation layer comprises a charge generation material and a binder resin. The material for the binder resin may be selected from formal resin, acetal resin, butyral resin, vinyl chloride-vinyl acetate resin, vinyl chloride resin, vinyl acetate resin and polyester resin, but the material is not limited to these materials.

While the charge generation material may be selected from commonly used materials and not limited to any specific material, phthalocyanine is preferably used. In the phthalocyanine to be used in the invention, the phthalocyanine ring may be substituted by a halogen atom or an optionally substituted alkyl group. The phthalocyanine in the invention may be selected from the phthalocyanines of which the core is a transition metal or a heavy metal such as copper, aluminum, indium, vanadium, titanium or tin, and an oxide or a halide of these metals. The phthalocyanine may also be selected from phthalocyanine oligomers, in which the core metals are bonded through an oxygen atom. Examples of the phthalocyanine oligomer include gallium phthalocyanine dimer, aluminum phthalocyanine dimer and silicon phthalocyanine dimer, for example.

The binder resin listed above may also be used in combination with a bisazo compound which is used as a charge generation material in a photoconductor for use in a copier, as well as in combination with a phthalocyariine compound.

While a phthalocyanine compound and a bisazo compound are known to exhibit polymorphism, the compounds in any crystal form may be used in combination with the binder resin in the invention. A phthalocyanine compound dispersed in coating liquid so as to have a particle diameter of 300 nm or less, more preferably 200 nm or less, is particularly favorable for maintaining excellent dispersion condition. Specific examples of the phthalocyanine compound and the bisazo compound that may be used in the invention are shown by the following formulas (3-1) to (3-8), and (4-1) to (4-14), respectively.

(3-1)

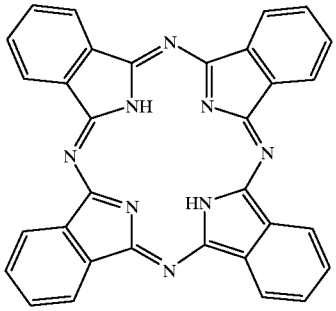

(3-2)

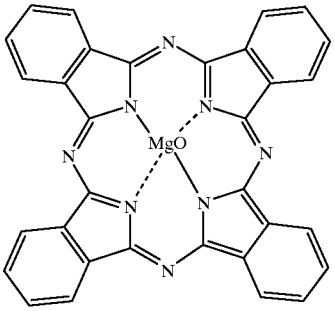

(3-3)

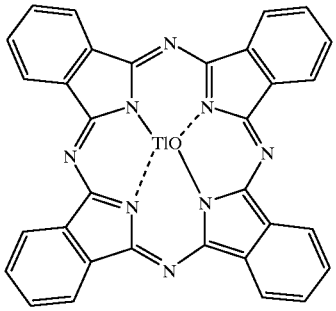

(3-4)

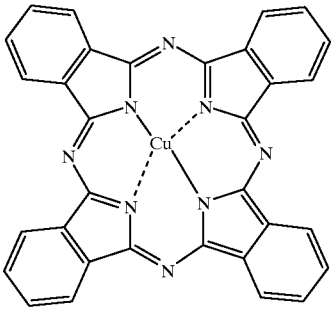

(3-5)

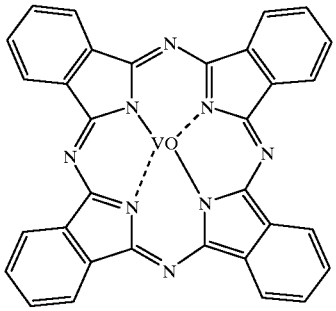

(3-6)

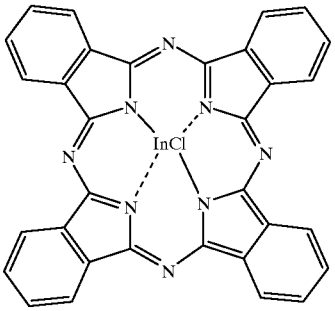

(3-7)

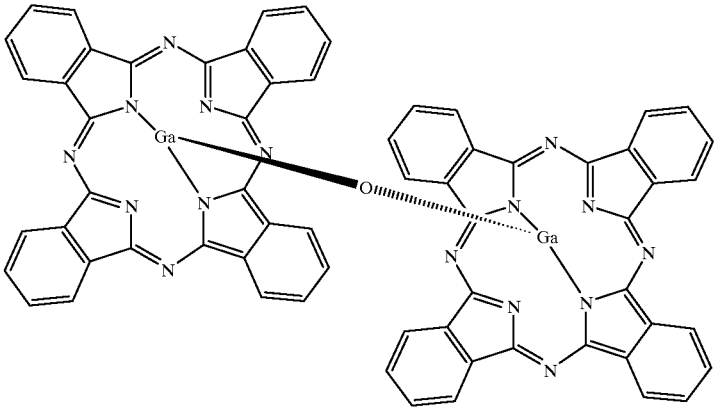

-continued
(3-8)
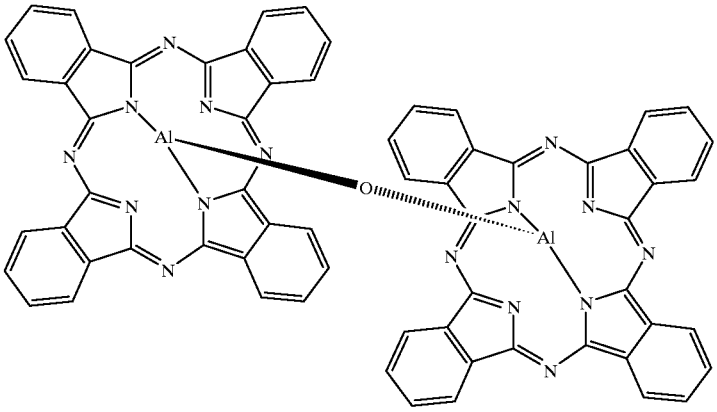
(4-1)
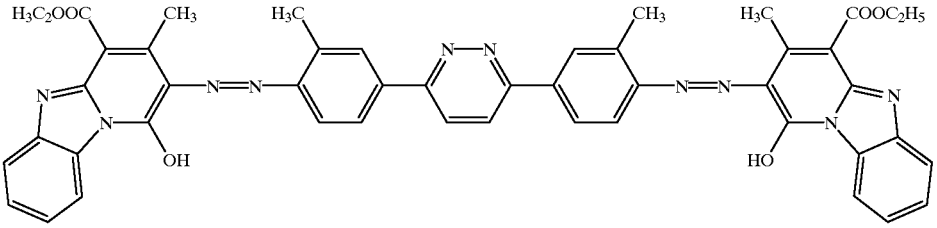
(4-2)
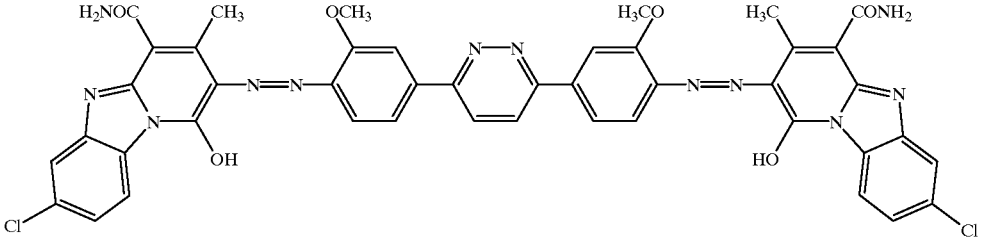
(4-3)
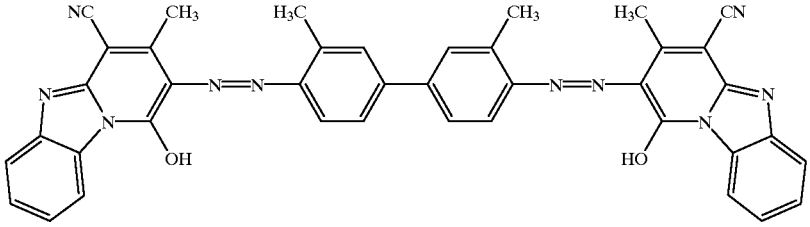
(4-4)
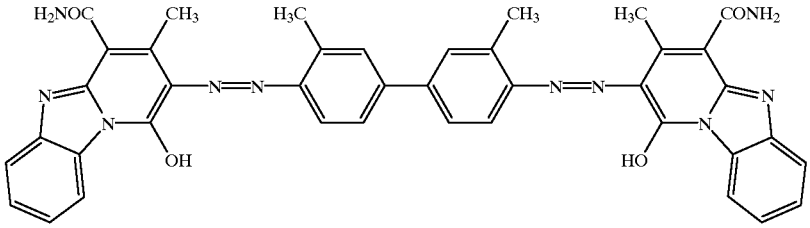

-continued
(4-5)
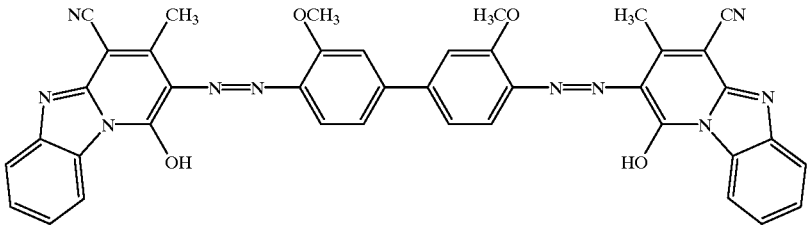
(4-6)
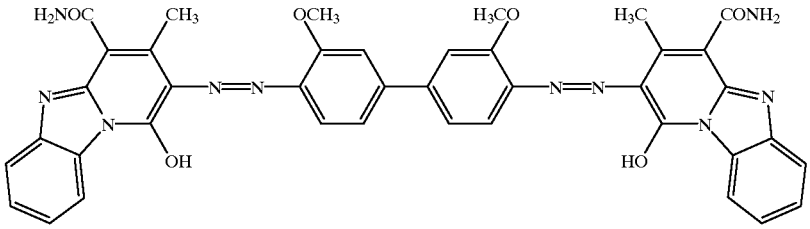
(4-7)
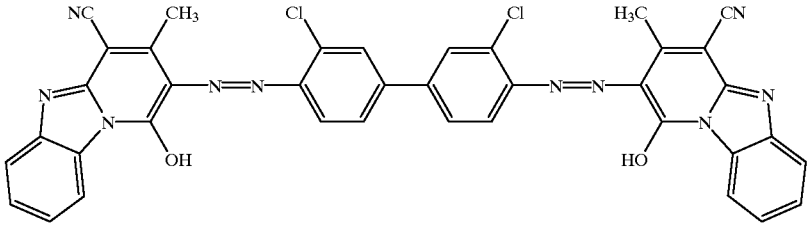
(4-8)
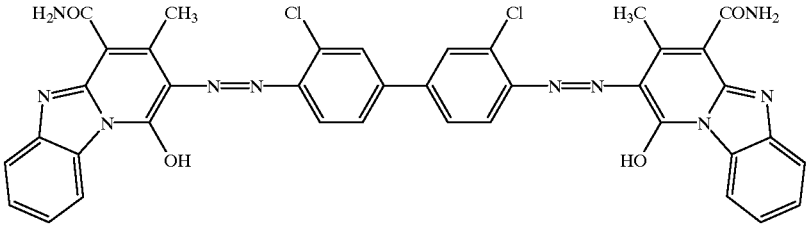
(4-9)
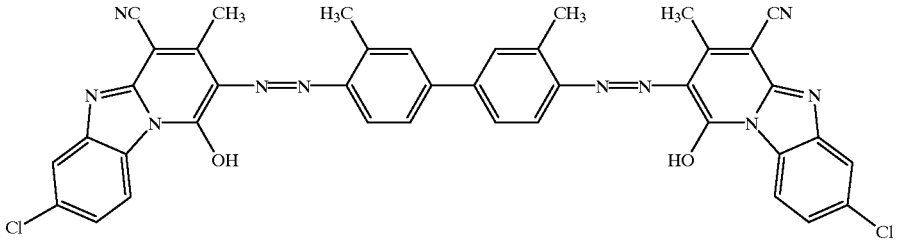
(4-10)
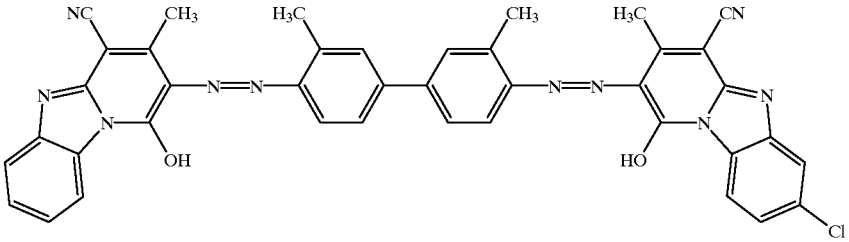

-continued (4-11)

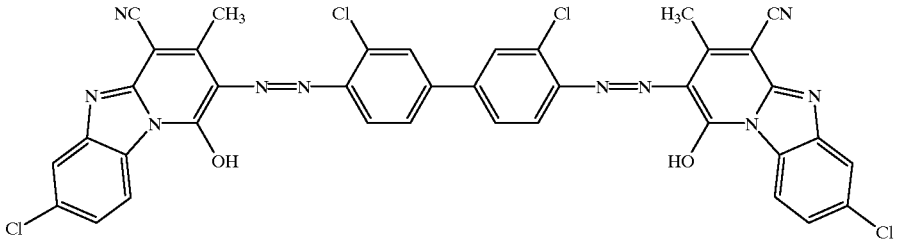

(4-12)

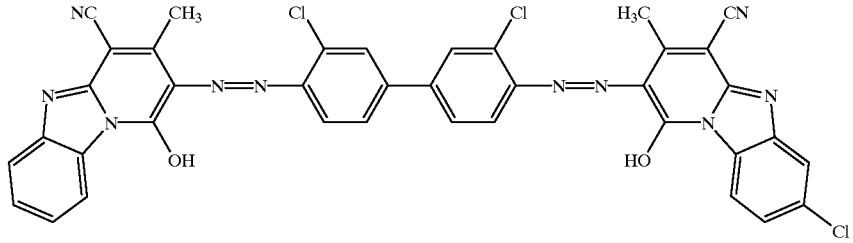

(4-13)

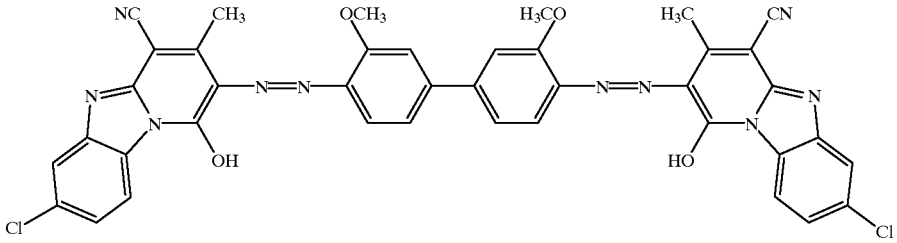

(4-14)

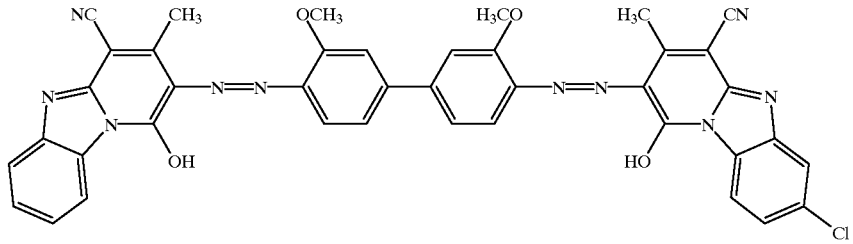

Selection of a solvent for the coating liquid is also important for obtaining a favorable dispersion condition of the coating liquid and forming a uniform charge generation layer. Such a solvent may be selected from an aliphatic hydrocarbon halide such as methylene chloride or 1,2-dichloroethane, an etherified hydrocarbon such as tetrahydrofiran, a ketone such as acetone, methyl ethyl ketone or cyclohexanone, and an ester such as ethyl acetate or ethyl cellosolve.

The ratio of the charge generation material and the binder resin in the coating liquid is preferably controlled in the invention such that the proportion of the binder resin in the charge generation layer after coating and drying becomes 30 to 70 wt %. A more preferable composition of the charge generation layer is about 50 wt % of resin binder and about 50 wt % of charge generation material.

A coating liquid for the charge generation layer is produced by suitably combining the above-described compositions, treating the liquid by a dispersion machine such as a sand mill or paint shaker so as to control the diameter of the pigment particles in a favorable size, and serves to application. Coating may be performed by a dip-coating method or by a method utilizing an applicator, for example.

The charge transport layer is formed by coating the charge generation layer with a coating liquid and drying. The coating liquid for the charge transport layer may be prepared by dissolving a charge transport material alone or a mixture of a charge transport material and a binder resin in an appropriate solvent, and is coated by a dip-coating method or by a method utilizing an applicator. The charge transport material may be selected from hole transporting substances and electron transporting substances, corresponding to the charging method of the photoconductor in the machine, for example, a copier, a printer or a facsimile machine. The known substances for the charge transport material are exemplified in P. M. Borsenberger and D. S. Weiss eds., "Organic Photoreceptors for Imaging Systems", Marcel Dekker, Inc., 1993. Hole transporting substances include hydrazone compounds, styryl compounds, diamine compounds, butadiene compounds, indole compounds, stilbene compounds, and a mixture of these compounds. Electron transporting substances include benzoquinone derivatives, phenanthrenequinone derivatives, stylbenequinone derivatives and azoquinone derivatives. Some examples of the hole transporting substances are given by the following formulas (5-1) to (5-12).

(5-1)
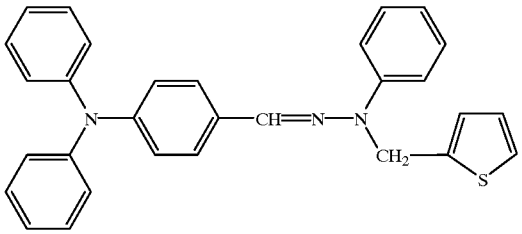
(5-2)
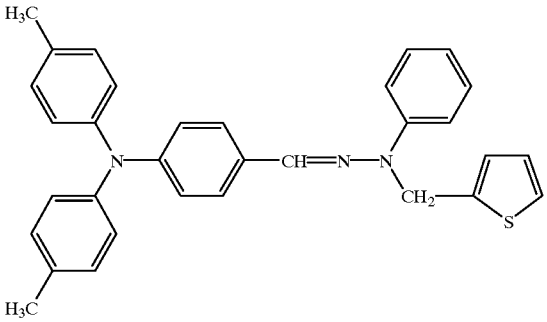
(5-3)
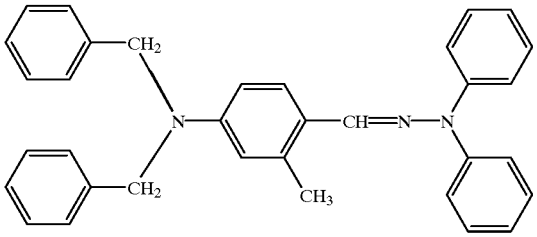
(5-4)
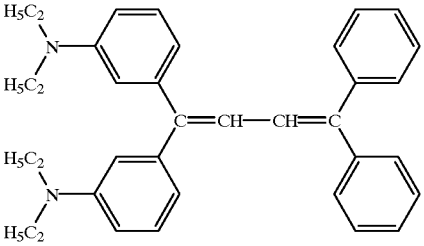
(5-5)
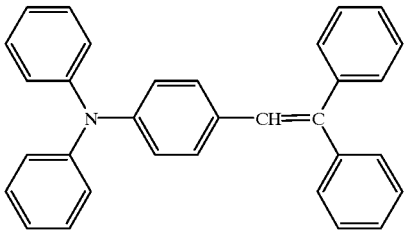
(5-6)
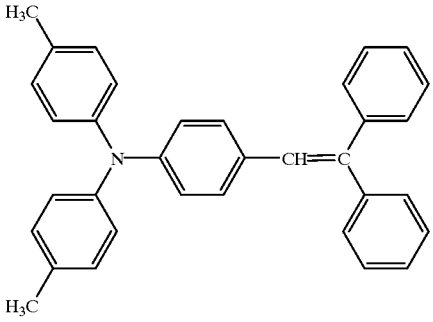
(5-7)
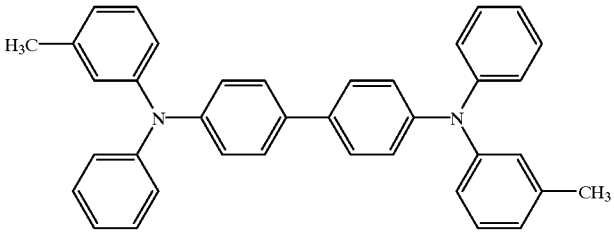
(5-8)
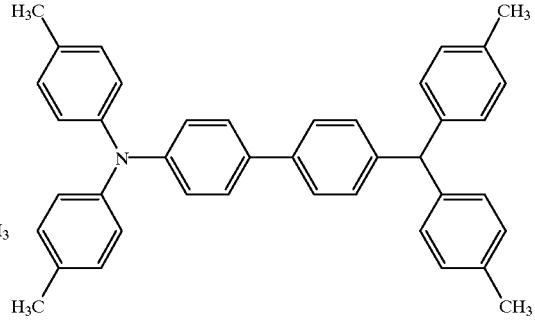
(5-9)
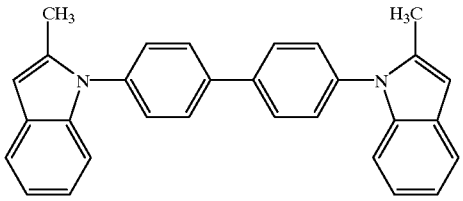
(5-10)
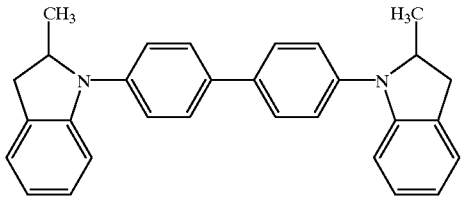

-continued (5-11)

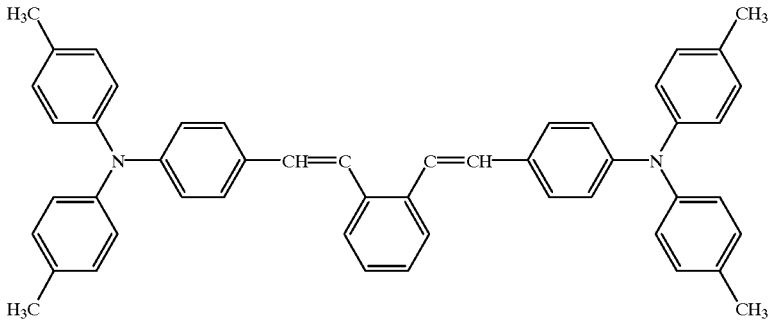

(5-12)

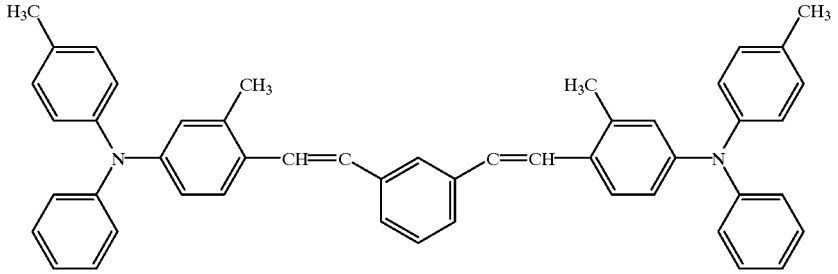

As a binder resin for forming a charge transport layer in combination with the above-described charge transport material, polycarbonate polymers are commonly used from the viewpoint of film strength and wear resistance. Such a polycarbonate polymer includes bisphenol A, bisphenol C, bisphenol Z, and a copolymer comprising a monomer unit constituting these bisphenols. The preferable range of molecular weight of the polycarbonate polymer is 10,000 to 100,000. In addition to the polycarbonate, the binder resin may also be selected from polyethylene, polyphenylene ether, acrylic resin, polyester, polyamide, polyurethane, epoxy resin, poly(vinyl acetal), poly(vinyl butyral), phenoxy resin, silicone resin, poly(vinyl chloride), poly(vinylidene chloride), poly(vinyl acetate), cellulose resin, and copolymers of these substances. The thickness of the charge transport layer is preferably 3 to 50 $\mu$m in view of charging characteristic and wear resistance of the photoconductor. Silicone oil may be added in the charge transport layer for smoothness of the surface. A surface protective layer may be formed on the charge transport layer, if necessary.

The photoconductor of the invention can be adapted to such a wide range of apparatuses involving a variety of electrophotographic processes that includes a printer, a facsimile machine, a digital copier and an analogue copier. A photoconductor of the invention may be used in a machine involving a non-contact charging process using a corotron or a scorotron, a contact charging process using a roller or a brush, and a developing process including a two-component development process, a non-magnetic one-component process, and a magnetic one-component process. The photoconductor of the invention may employ any material and any constitution that are described above. However, the radius measured by a positron annihilation method of the vacancy-type defect existing in any layer of the charge generation layer, the charge transport layer and the undercoat layer, must be 0.4 nm or less. When the radius of the vacancy-type defect is 0.4 nm or smaller, an excellent photoconductor with steady charging characteristic is obtained. Advantageously, the lifetime in the conductive substrate of a positron injected from an external radiation source, is 0.3 ns or shorter.

EXAMPLES

While the present invention will be explained with reference to the specific examples of the preferred embodiments thereof in the followings, aspects of embodiments of the invention should not be limited to the examples.

Example 1

An undercoat layer with thickness of 1.5 $\mu$m was formed on a conductive substrate of an aluminum cylinder by dip coating with a coating liquid and drying for 30 minutes at 145° C. The coating liquid for the undercoat layer was prepared by dispersing 2.5 parts by weight of a vinyl-phenol resin: MARUKA LYNCUR MH-2 manufactured by Maruzen Petrochemical Co., Ltd., 2.5 parts by weight of a melamine resin: U-VAN 20HS manufactured by Mitsui Chemicals, Inc., and 5 parts by weight of aminosilane-treated titanium oxide particles, in a liquid consisting of 75 parts by weight of methanol and 15 parts by weight of butanol.

A charge generation layer with thickness of 0.2 $\mu$m was formed on the undercoat layer by dip coating with a coating liquid and drying for 30 min at 80° C. The coating liquid for the charge generation layer was prepared by dissolving and dispersing 1 part by weight of a charge generation material of titanylphthalocyanine and 1 part by weight of poly(vinyl butyral) resin: S-LEC BX-1 manufactured by Sekisui Chemical Co., Ltd., in 98 parts by weight of dichloromethane, wherein the titanylphthalocyanine has a molecular structure represented by the formula (3-3) and has the crystal form falling into Phase II studied by W. Hiller et al. in Z. Kristallogr. 159 p. 173 (1982).

A charge transport layer with thickness of 15 $\mu$m was formed on the charge generation layer by dip coating with a coating liquid and drying for 60 min. at 90° C. The coating liquid for the charge transport layer was prepared by dissolving 9 parts by weight of a stilbene compound represented by the formula (5-11) as a charge transport material and 11 parts by weight of a polycarbonate resin as a binder resin: TOUGHZET B-500, a bisphenol A-biphenyl copolymer manufactured by Idemitsu Kosan Co., Ltd., in 55 parts by weight of dichloromethane. Thus, a photoconductor of Example 1 was produced.

Example 2

A photoconductor was produced in the same manner as in Example 1 except that the compound of the formula (5-3) was used as a charge transport material in place of the compound of the formula (5-11).

Example 3

A photoconductor was produced in the same manner as in Example 1 except that the compound of the formula (5-4) was used as a charge transport material in place of the compound of the formula (5-11).

Example 4

A photoconductor was produced in the same manner as in Example 1 except that the bisphenol Z polycarbonate resin: PANLITE TS2050 manufactured by Teijin Chemical Co., Ltd. was used as a binder resir of the charge transport layer in place of the bisphenol A-biphenyl copolymer: TOUGHZET B-500.

Comparative Example 1

A photoconductor was produced in the same manner as in Example 1 except that poly(methyl methacrylate) manufactured by Sigma-Aldrich, Inc., USA was used as the binder resin of the charge transport layer in place of bisphenol A-biphenyl copolymer: TOUGHZET B-500.

Comparative Example 2

A photoconductor was produced in the same manner as in Example 1 except that polyester resin: BYLON 200 manufactured by Toyobo Co., Ltd. was used as the binder resin of the charge transport layer in place of bisphenol A-biphenyl copolymer: TOUGHZET B-500.

Evaluations on electrophotographic characteristics of the photoconductors of Examples 1 to 4 and Comparative Examples 1 and 2 were performed as follows.

Initially, a surface of a photoconductor was charged to about −650 V by corona discharge in the dark, and a surface potential $V_0$ was measured immediately after charging. Then, a surface potential $V_5$ was measured 5 seconds after stopping the charging with the photoconductor being held in the dark for this period, to obtain a charge retentivity rate $V_{k5}$ (%) defined by formula (6) below.

$$V_{k5}=V_5/V_0\times 100 \quad (6)$$

The surface of the photoconductor was then exposed to light of 780 nm separated by a band-pass filter from light of a halogen lamp and adjusted to a radiation density of 1.0 $\mu$W $cm^{-2}$. The irradiation continued for 5 seconds. During the period, the irradiated light energy was measured from the time when the surface potential was −600 V to the time when the surface potential decayed to −100 V due to the light energy, to determine sensitivity $E_{100}$ ($\mu$J $cm^{-2}$). The surface potential when the accumulated light energy amounted to 5.0 $\mu$J $cm^{-2}$ was measured as residual potential $V_{r5}$.

Measured electrical characteristics of the photoconductors of Examples 1 to 4 and Comparative Examples 1 and 2 are shown in Table 1.

TABLE 1

| | retention rate Vk5 (%) | sensitivity E100 ($\mu$J cm-2) | residual potential Vr5 (V) |
|---|---|---|---|
| Example 1 | 96.2 | 0.41 | 5 |
| Example 2 | 95.7 | 0.41 | 6 |
| Example 3 | 94.9 | 0.40 | 5 |
| Example 4 | 96.2 | 0.37 | 7 |
| Comp. Ex. 1 | 95.0 | 0.41 | 15 |
| Comp. Ex. 2 | 94.0 | 0.39 | 17 |

The characteristics of charge retentivity and sensitivity showed very little difference between Examples 1 to 4 and Comparative Examples 1 and 2, as shown in Table 1. However, it is apparent from the Table 1 that the residual potential is larger, or worse, in Comparative Examples 1 and 2 than in Examples 1 to 4.

In order to study the difference in the charged potential of the photoconductor after the first turn and the charged potential after the second and later turns, each of the photoconductors of Examples and Comparative Examples was mounted on a digital copier which was modified to perform a copying process from the first turn on with a process speed of 190 mm/s. An original with a print density of 1% was set on the copier. It was observed that the difference in the charged potential became notable when the photoconductor experienced stresses in the actual process, for example, electric charging or light exposure, though the reason for this is not thoroughly understood. To reproduce actual application condition, 80,000 copying processes were performed. on each Example and Comparative Example, each process including charging, light exposure, development, image transfer and cleaning in a reverse development process, but without setting printing paper. This series of processes corresponds to the printings on 80,000 sheets of A4 paper. Thirty minutes later, a blank original paper and a surface potential meter were attached and a copy was made on a sheet of A3 paper running in the longitudinal direction. The surface potentials at the first turn and the second turn of the photoconductor were measured, and the difference was obtained. Table 2 shows the results.

TABLE 2

| | surface potential at 1st turn (V) | surface potential at 2nd turn (V) | diff. between 1st and 2nd turns (V) |
|---|---|---|---|
| Example 1 | 605 | 610 | 5 |
| Example 2 | 609 | 615 | 6 |
| Example 3 | 607 | 612 | 5 |
| Example 4 | 606 | 610 | 4 |
| Comp. Ex. 1 | 570 | 610 | 40 |
| Comp. Ex. 2 | 528 | 603 | 75 |

Examples 1 to 4 showed very little difference between the surface potential values at the first and the second turns, as is apparent in Table 2. Immediately after the potential measurement on each of Examples 1 to 4, a copy of an original containing only half-tone was made. Non-uniformity on the copied image was not observed. However, with respect to Comparative Examples 1 and 2, the difference in the surface potential values at first and second turns was very large as shown in Table 2. When a copy of an original with only half-tone was made for each of Comparative Examples 1 and 2, the density of the portion of the copied image corresponding to the first turn of the photoconductor was more intense than other portions. Thus, notable non-uniformity was observed.

The radius of the vacancy in each of the photoconductors of Examples 1 to 4 and Comparative Examples 1 and 2 was measured as follows.

Measurement of the positron lifetime was conducted in a typical fast-fast coincidence arrangement as disclosed by J. Bartos et al., in Macromolecules 1997, 30, pp. 6906–6912. The radiation source 3 was sandwiched between two Kapton films 4 each having thickness of 7.5 μm and sealed with epoxy adhesive, as shown in FIG. 2. The intensity of the γ-ray from this radiation source was 370 kBq.

Two test pieces were cut in a suitable size from each of the photoconductors of the Examples and Comparative Examples. The two test pieces sandwiched the radiation source such that the surface coated with a charge transport layer of each test piece faced the radiation source, to prepare a specimen containing the radiation source for the measurement. The specimen containing the radiation source was disposed between two plastic scintillators 1 (abbreviated simply to 'scintillator') each mounted to a photomultiplier tube 17. Here, the radiation receiving faces of the two scintillators were arranged opposing each other at an angle of 180°.

In the first scintillator side of the measuring system, γ-ray with energy of 1,275 keV emitted by the decay from $^{22}$Na in the radiation source to $^{22}$Ne was selected and designated as a start signal of the measurement. The selection was performed by putting the scintillator-output into a differential pulse form discriminator 18. A positron was emitted approximately simultaneously with the γ-ray and penetrated into the charge transport layer side of the test piece. The positron, through the pick-off process, emitted the annihilation γ-rays of 511 keV in two directions. In the second scintillator side of the measuring system, the annihilation γ-ray with energy of 511 keV was selected in the similar manner as in the first scintillator side, and the signal indicating disappearance of the positron was received and designated as an end signal of the measurement. As shown in FIG. 1, the start signal was directly applied to the time-amplitude converter 19 and the end signal was applied there through a delay circuit 21. The time interval between the two signals was taken out of the time-amplitude converter as an electric signal, which was put into a pulse-height analyzer 20 and stored, to obtain a time spectrum L(t) showing the situation of the positron disappearance.

The thus obtained time spectrum allowed analysis with a high accuracy by the formula (1) assuming two components of exponential functions. The time constant of the first component was 0.16 to 0.30 ns which was attributed to the lifetime of free annihilation of a positron in the conductive substrate, considering the positron annihilation mechanism described earlier. The time constant of the second component was between 1 and 4 ns which was attributed to the pick-off annihilation of an orthopositronium. A vacancy radius in each of the photoconductors was determined from the time constant of the second component using the formula (2). Table 3 shows intensity I and time constant τ for each of the components, and vacancy radius R, as well as a residual potential $V_{r5}$ and a double charge difference which is a difference in electric potential between the first turn and the second turn.

TABLE 3

| | I(1) (%) | τ(1) (ns) | I(2) (%) | τ(2) (ns) | R (nm) | Vr5 (V) | diff. betw. 1st & 2nd turns (V) |
|---|---|---|---|---|---|---|---|
| Example 1 | 92.14 | 0.252 | 7.86 | 1.56 | 0.241 | 5 | 5 |
| Example 2 | 93.56 | 0.233 | 6.44 | 1.76 | 0.263 | 6 | 6 |
| Example 3 | 93.50 | 0.239 | 6.50 | 1.78 | 0.264 | 5 | 5 |
| Example 4 | 92.50 | 0.250 | 7.50 | 1.25 | 0.204 | 7 | 4 |
| Comp. Ex. 1 | 92.09 | 0.251 | 7.91 | 3.70 | 0.408 | 15 | 40 |
| Comp. Ex 2 | 93.11 | 0.253 | 6.89 | 3.91 | 0.420 | 17 | 75 |

As is apparent from Table 3, the residual potential characteristic and the steadiness of charging are excellent when the vacancy radius is not more than 0.4 nm.

A photoconductor according to the present invention comprises a conductive substrate, an undercoat layer on the substrate if necessary, and at least one photosensitive layer, wherein the photoconductor uses such a combination of materials that the vacancy-type defects in each of the photosensitive layer and the undercoat layer has vacancy radius of 0.4 nm or less measured by the positron annihilation method. Such a combination of materials provides a photoconductor that exhibits an excellent charging characteristic and makes image formation possible beginning with the first turn.

Having described preferred embodiments of the invention with reference to the accompanying drawings, it is to be understood that the invertion is not limited to those precise embodiments, and that various changes and modifications may be effected therein by one skilled in the art without departing from the scope or spirit of the invention as defined in the appended claims.

What is claimed is:

1. An electrophotographic photoconductor comprising:

a conductive substrate;

a photosensitive layer on said conductive substrate; and a radius of vacancy type defects in said photosensitive layer is 0.4 nm or less.

2. An electrophotographic photoconductor according to claim 1, wherein said radius of vacancy type defects is a value measured by a positron annihilation method.

3. An electrophotographic photoconductor according to claim 1, wherein a lifetime in said conductive substrate of a positron that is injected from an external radiation source is 0.3 ns or less.

4. An electrophotographic photoconductor according to claim 1, wherein said photosensitive layer is a single layer.

5. An electrophotographic photoconductor according to claim 1, wherein said photosensitive layer includes a charge generation layer and a charge transport layer.

6. An electrophotographic photoconductor comprising:

a conductive substrate, an undercoat layer on said conductive substrate, and a photosensitive layer formed on said undercoat layer; and a radius of vacancy type defects in each of said photosensitive layer and said undercoat layer is 0.4 nm or less, said radius being a value measured by a positron annihilation method.

7. An electrophotographic photoconductor according to claim 6, wherein said radius of vacancy type defects is a value measured by a positron annihilation method.

8. An electrophotographic photoconductor according to claim 6, wherein said photosensitive layer comprises a charge generation layer and a charge transport layer.

9. An electrophotographic photoconductor according to claim 6, wherein said photosensitive layer is a single layer.

10. An electrophotographic photoconductor according to claim 6, wherein a lifetime in said conductive substrate of a positron that is injectec from an extenial radiation source is 0.3 ns or less.

* * * * *